United States Patent [19]

Sakazume et al.

[11] Patent Number: 4,638,643

[45] Date of Patent: Jan. 27, 1987

[54] CONTROL SYSTEM FOR COMPRESSOR MOTOR USED WITH AIR-CONDITIONING UNIT

[75] Inventors: Akio Sakazume; Hiroki Yoshikawa; Hiroaki Matsushima, all of Yokohama, Japan

[73] Assignee: Hitachi, Ltd., Tokyo, Japan

[21] Appl. No.: 767,807

[22] Filed: Aug. 21, 1985

[30] Foreign Application Priority Data

Aug. 22, 1984 [JP] Japan ..... 59-173224

[51] Int. Cl.[4] ..... F25B 1/00

[52] U.S. Cl. ..... 62/209; 62/228.1; 318/436

[58] Field of Search ..... 62/209, 228.1, 226, 62/215, 208; 318/436

[56] References Cited

U.S. PATENT DOCUMENTS 3,466,888 9/1969 Kyle ..... 62/156
4,135,122 1/1979 Holmquist et al. ..... 318/436

FOREIGN PATENT DOCUMENTS 864669 2/1971 Canada ..... 318/436
157970 9/1982 Japan .

*Primary Examiner*—Harry Tanner
*Attorney, Agent, or Firm*—Antonelli, Terry & Wands

[57] ABSTRACT

A control system for a compressor motor used with an air conditioning unit is disclosed. A current for generating a non-rotating magnetic field is supplied to the compressor motor to preheat a compressor. A current for generating a rotating magnetic field is also supplied to the compressor motor together with the current for generating a non-rotating magnetic field to heat the compressor. The heat pump using this control system is thus capable of transmitting sufficient heat energy immediately after start of the operation of the heat pump.

8 Claims, 8 Drawing Figures

CONTROL SYSTEM FOR COMPRESSOR MOTOR USED WITH AIR-CONDITIONING UNIT

BACKGROUND OF THE INVENTION

Field of the Invention

The present invention relates to a control system for a compressor motor used with an air-conditioning unit or a heat pump, or more in particular to a control system for controlling the electric current flowing in the windings of the motor to heat the motor and preheat the compressor. Generally, an air-conditioning unit or a heat pump comprises, as disclosed in U.S. Pat. No. 3,466,888, a refregeration system including a refrigerant compressor, an indoor coil (indoor heat exchanger), an outdoor coil (outdoor heat exchanger), a reversal valve and a restrictor on the one hand, and a control system for a compressor motor for driving the compressor, an indoor fan for supplying indoor air to the indoor coil, an outdoor fan for supplying outdoor air to the outdoor coil and a solenoid for driving the reversal valve on the other hand.

The heat pump acquires heat energy from the outdoor air through the outdoor coil, and applies the particular heat energy to the indoor air through the indoor coil to heat the indoor air. In the case where the heat pump is started when the compressor is low in temperature at low outdoor temperature, the heat energy acquired from the outdoor air is consumed to heat the compressor and therefore fails to heat the indoor air sufficiently. It thus takes a long time before the indoor air is sufficiently heated.

If the heat pump is in operation for a long time at a low outdoor temperature, on the other hand, the surface of the outdoor coil is frosted to reduce the heat exchange efficiency of the outdoor coil. Therefore, the surface of the outdoor coil must be defrosted before the frost forms in a great amount. The outdoor coil is defrosted by reversing the flow of the refrigerant gas passing through the outdoor coil by the reversal valve as an example. The outdoor fan is normally kept stopped during the defrosting operation. The heat energy required for defrosting is mainly derived from the heat energy accumulated in the compressor as a whole.

Japanese Patent Unexamined Publication No. 157970/82 discloses a system for heating a compressor by the current flowing in an electric heater arranged around the compressor. This system applies current to the electric heater to heat the compressor before starting a heat pump. As a result, the time required for heating the indoor air sufficiently is reduced. The heater of this system which is arranged on the surface of a compressor case, however, is difficult of heating the interior of the compressor. Further, since heat easily escapes outside of the compressor case, the efficiency of heating the compressor is low. Also, the compressor is naturally high in cost.

SUMMARY OF THE INVENTION

Accordingly, the object of the present invention is to provide means capable of heating a compressor at high efficiency, or more in particular to a system capable of heating a compressor without using a heater on the compressor case.

A current for driving a compressor motor flows in the windings of a compressor motor for driving the compressor. This current generates a rotating magnetic field in the rotor or stator of the motor. In the case where the rotor of the motor rotates under no load by the rotating magnetic field generated by the current flowing in the windings of the motor, for example, most of the current is reactive and only a small part thereof active. No heat therefore is generated in the motor windings. If a current not generating a rotating magnetic field, that is, a current generating a non-rotating magnetic field flows through the motor windings, however, the rotor of the motor fails to be driven, so that heat is generated in the motor windings by the current. Since the resistance value of the motor windings is normally small, the amount of current generating a non-rotating magnetic field is great, thereby easily generating a great heat in the motor windings.

A system according to the present invention comprises means for heating the compressor motor by supplying a current for generating a non-rotating magnetic field to the windings of a compressor motor thereby to heat the compressor.

DESCRIPTION OF THE PREFERRED EMBODIMENTS

Figure 1:
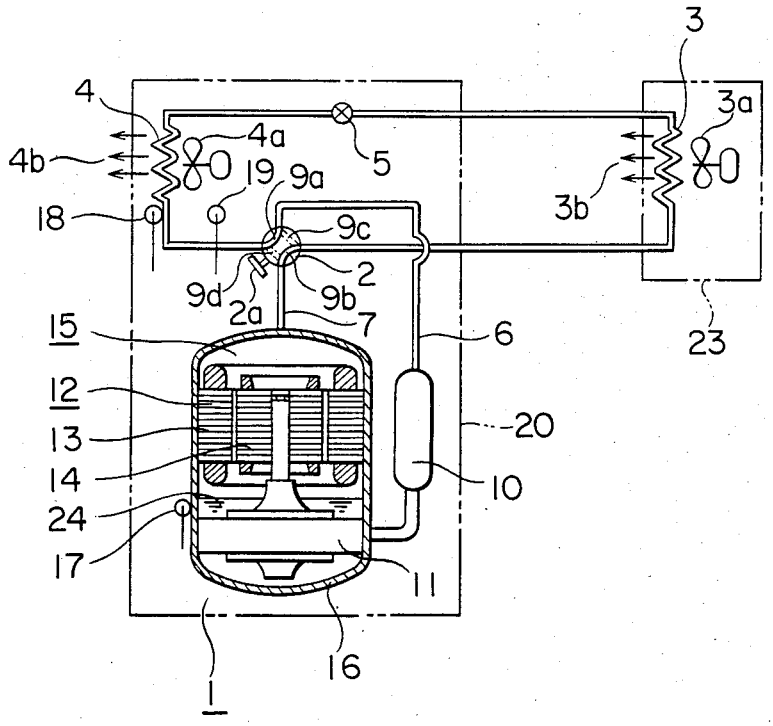
FIG. 1 is a block diagram showing an example of a heat pump with which a control system according to the present invention is used.

A refrigeration system using a control system according to the present invention is shown in FIG. 1. This refrigeration system comprises an outdoor unit 1 and an indoor unit 23. The outdoor unit 1 includes a refrigerant compressor 15. A reversal valve 2, an outdoor coil 4, a restrictor 5, a suction tank 10 and an outdoor fan 4*a*. The compressor 15 has a compressor motor 12 and compression parts 11 arranged in a case 16. The compression parts 11 is driven by a compressor motor 12. The case 16 is also filled with a refrigeration oil 24. The compressor motor 12 includes a stator 13 and a rotor 14. The indoor unit 23 includes an indoor coil 3 and an indoor fan 3*a*. Thermistors 17, 18 and 19 are arranged in the outdoor unit 1 as a temperature detection device. The thermistor 18 which is arranged near the surface of the outdoor coil is for detection of the temperature of the outdoor coil. The thermistor 19 is disposed in the passage of the outdoor air 4*b* carried by the outdoor fan 4*a* to detect the temperature of the air 4*b*. The thermistor 17, disposed near the case of the compressor 15, is used to detect the temperature of the compressor 15. When the reversal valve 2 is positioned in the state shown by solid lines 9*a*, 9*b* by the solenoid 2*a* of the reversal valve 2, the refrigerant gas compressed by the compressor 15 is supplied to the indoor coil 3 through the reversal valve 2 from a delivery pipe 7. The refrigerant gas imparts heat energy to the indoor air 3*b* carried by the indoor fan 3*a* at the indoor coil 3 thereby to heat the indoor air 3*b*. The refrigerant gas that has passed through the indoor coil 3 is reduced in pressure at the restrictor 5, and then supplied to the outdoor coil 4. At the outdoor coil 4, the refrigerant gas acquires heat energy from the outdoor air 4*b* carried by the outdoor fan 4*a*, and subsequently, returns to the compressor 15 through the reversal valve 2, suction pipe 6 and the suction tank 6. In the case where the compressor 15 is low in temperature, the heat energy acquired by the refrigerant gas from the outdoor air 4*b* is consumed for heating the compressor 15 but not carried to the indoor coil 3. When a current for generating a nonrotating magnetic field in the stator 13 flows in the stator 13 of the compressor motor 12, the stator 13 is heated by the current. As a consequence, the compressor 15 is increased in temperature. With the increase in the temperature of the compressor 15, the heat energy acquired by the refrigerant gas from the outdoor air is not consumed for heating the compressor 15. As long as the temperature of the compressor 15 is sufficiently high, the refrigerant gas acquires heat energy from the compressor 15. This refrigerant gas is capable of supplying these heat energy to the indoor coil 3.

Assume that the reversal valve 2 is switched to the position shown by dashed lines 9*c*, 9*d* by the solenoid 2*a* of the reversal valve 2. The refrigerant gas compressed by the compressor 15 is carried through the reversal valve 2 to the outdoor coil 4 thereby to heat the outdoor coil 4, with the result that the outdoor coil 4 is defrosted. For the purpose of defrosting the outdoor coil 4, heat energy stored in the compressor 15 is generally used. If the current for generating a non-rotating magnetic field is superimposed on the current for generating a rotating magnetic field while the outdoor coil 4 is being defrosted, the compressor 12 is heated while being rotated, so that the outdoor coil 4 is supplied with sufficient heat energy from the compressor 15. The outdoor coil 4 is thus defrosted easily.

Figure 2:
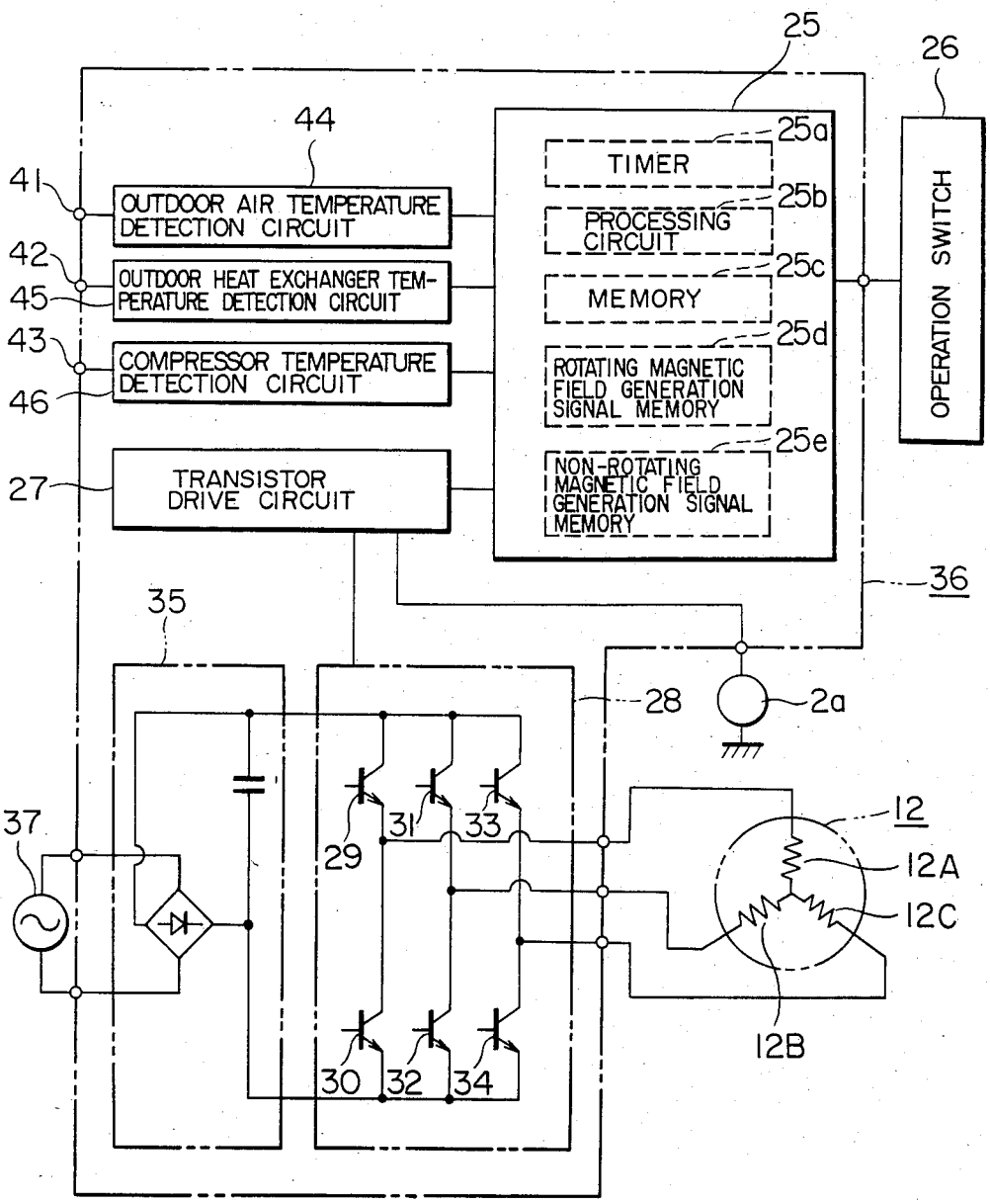
FIG. 2 is a block diagram showing a control system according to the present invention.

A block diagram of a control system according to the present invention is shown in FIG. 2. This control system 36 comprises a microcomputer 25, a transistor circuit 27, a compressor motor drive circuit 28, a power circuit 35, an outdoor air temperature detection circuit 44, an outdoor coil temperature detection circuit 45 and a compressor temperature detection circuit 46. The microcomputer 25 is connected with temperature detection circuits 44, 45, 46 on the one hand and a transistor drive circuit 27 on the other hand. The transistor drive circuit 27 is connected to the compressor motor drive circuit 28, which in turn is connected to the power circuit 35. The temperature detection circuits 44, 45, 46, the microcomputer 25 and the transistor drive circuit 27 are also of course supplied with current from the power circuit 35. The power circuit 35 is connected to a commercial power supply 37. The compressor motor drive circuit 28 is connected to the compressor motor 12. The microcomputer 25 is connected with an operation switch. The transistor drive circuit 27 is connected with the solenoid 2*a* of the reversal valve 2. The outdoor air temperature circuit 44 is connected to the thermistor 19 through a terminal 41. The outdoor coil temperature detection circuit 45 is connected to the thermistor 19 through a terminal 42. The compressor temperature detection circuit 46 is connected through a terminal 43 to the thermistor 17. The compressor motor drive circuit 28 includes three pairs of transistors 29, 30; 31, 32 and 33, 34. The transistors 29 and 30 connected in series with each other are connected to the winding 12A of the compressor motor 12. The transistors 31 and 32 connected in series with each other are connected to the winding 12B. The transistors 33 and 34 in series are connected to the winding 12C. The microcomputer 25 includes a timer 25*a*, processor 25*b* and a memory 25*c*. The memory 25*c* has a rotating magnetic field generation signal memory unit 25*d* for storing data on the rotating magnetic field generation signal and a non-rotating magnetic field generation signal memory unit 25*e* for storing a non-rotating magnetic field generation signal.

Figure 3:
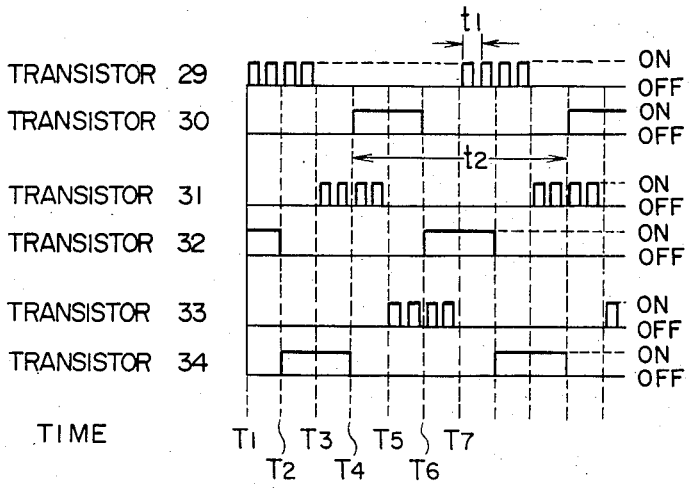
FIG. 3 is a diagram showing waveforms of signals for generating a rotating magnetic field in a compressor motor.

FIG. 3 shows signals for generating a rotating magnetic field with the transistors 29, 30, 31, 32, 33 and 34 turned on and off. The transistors 29, 31 and 33 are turned on and off during a period $t_2$, and the transistors 30, 32 and 34 during the period $t_2$. During the period from time $T_1$ to $T_2$, only the transistors 29 and 32 are turned on to supply current through the windings 12A and 12B of the compressor motor 12. During the period from time $T_2$ to $T_3$, the transistors 29 and 34 alone are turned on to supply current through the windings 12A and 12C. During the period from time $T_3$ to $T_4$, on the other hand, only the transistors 31 and 34 are turned on to supply current via the windings 12B and 12C. During the period from time $T_4$ to $T_5$, only the transistors 31 and 30 are turned on to supply current through the windings 12B and 12A. During the period from time $T_5$ and $T_6$, only the transistors 33 and 30 are turned on to apply current through the windings 12C and 12A. During the time period from time $T_6$ to $T_7$, the transistors 33 and 32 alone are turned on to supply current to the windings 12C and 12B. A cycle is thus ended to return to the same state at time point $T_7$ as at time point $T_1$. These current flows generate a rotating magnetic field in the compressor motor 12 thereby to drive the rotor 14.

Figure 4:
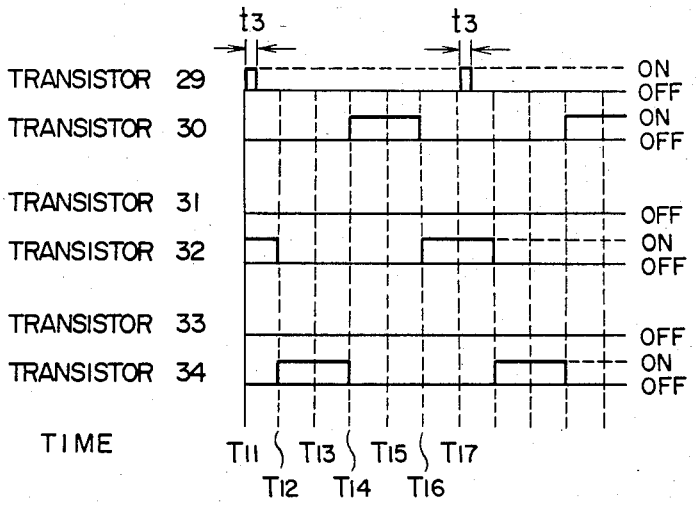
FIG. 4 is a diagram showing waveforms of signals for generating a non-rotating magnetic field in the compressor motor.

An example of signals for generating a non-rotating magnetic field is shown in FIG. 4. In this example, the transistors 31 and 33 are off during the period from time $T_{11}$ to $T_{17}$ and therefore any rotating magnetic field is not generated during that period. During the time period $t_3$ from time point $T_{11}$ to $T_{12}$, on the other hand, the transistors 29 and 32 are turned on at the same time, and therefore current flows through the windings 12A and 12B during this period. This current is converted into heat energy by the internal resistance of the windings 12A and 12B thereby to heat the windings 12A and 12B.

Figure 5:
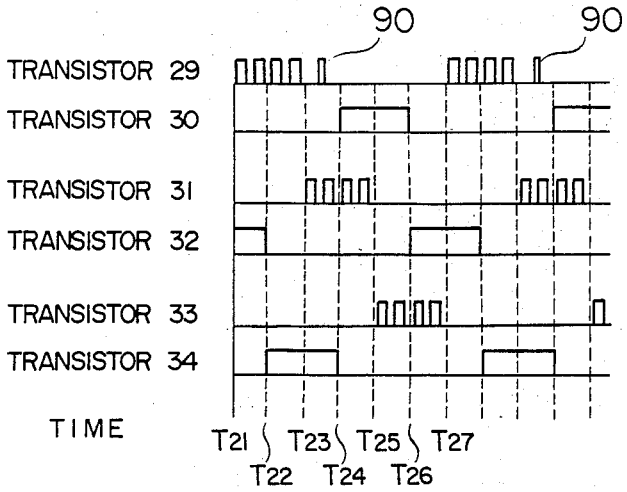
FIG. 5 shows waveforms of signals including signals for generating a rotating magnetic field and signals for generating a non-rotating magnetic field.

FIG. 5 shows a signal for generating a rotating magnetic field superimposed on a signal for generating a non-rotating magnetic field. The signals generated during the periods from time $T_{21}$ to $T_{23}$ and from time $T_{24}$ to $T_{27}$ in FIG. 5 are the same as those generated during the periods from time $T_1$ to $T_3$ and from time $T_4$ to $T_7$ respectively in FIG. 3. During the period from time $T_{23}$ to $T_{24}$, the transistor 29 is kept on by the signal 90. As a result, a main current flows from the transistor 31 through the windings 12B and 12C to the transistor 34 on the one hand, and an auxiliary current from the transistor 29 through the windings 12A and 12C to the transistor 34 on the other hand. This auxiliary current reduces the efficiency of the compressor motor 12, so that the temperature of the compressor motor 12 is increased by the energy loss caused by the auxiliary current.

The signals shown in FIGS. 4 and 5 are an example of simplest forms of signals for generating a non-rotating magnetic field. Various other forms of signals for generating a non-rotating magnetic field are possible.

Functions of the control system according to the present invention will be explained with reference to FIG. 2.

First, explanation will be made about the functions of starting the operation of the air conditioner. The time to start the air conditioner is set in the microcomputer 25 by an operation switch 26. This time is recorded in the memory 25*c*. The timer 25*a* has a clock function. The time on the timer 25*a* is compared with the time stored in the memory 25*c* repeatedly by the processing circuit 25*b*. When the time on the timer 25*a* is advanced by a predetermined time from the time stored in the memory 25*c*, the processing circuit 25*b* reads out the signal recorded in the non-rotating magnetic field generation signal memory 25, and applies the same signal through the transistor drive circuit 27 to the compressor motor drive circuit 28. This non-rotating magnetic field generation signal causes a current to flow repeatedly in the windings 12A and 12B during the period $t_3$ shown in FIG. 4 thereby to heat the compressor motor 12. The compressor motor 12 is thus heated (preheated) until the time on the timer 25*a* comes to coincide with the time stored in the memory 25*c*. The heat generated in the compressor motor 12 is transmitted to the whole compressor 15 thereby to increase the temperature of the compressor 15. When the time on the timer 25*a* comes to coincide with the time to start motion stored in the memory 25*c*, on the other hand, the processing circuit 25*b* stops supplying the non-rotating magnetic field generation signal, and receives the rotating magnetic field generation signal from the rotating magnetic field generation signal memory 25*d*, which is supplied through the transistor drive circuit 27 to the compressor motor drive circuit 28. As a result, a current for generating a rotating magnetic field is supplied from the compressor motor drive circuit 28 to the windings 12A, 12B and 12C of the compressor motor 12 thereby to start the operation of the air conditioner.

Figure 6A:
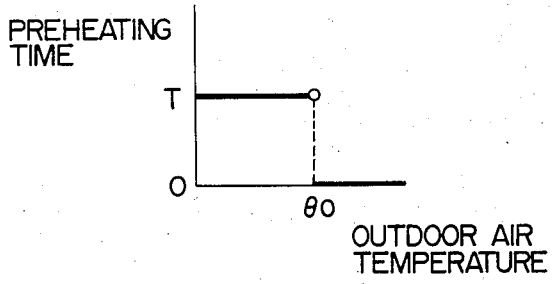
FIGS. 6*a* and 6*b* are graphs showing the relationship between an atmospheric temperature and a preheating time.

In the aforementioned embodiment, the compressor 15 is always preheated before starting the operation of the air conditioner. When the temperature of the outdoor air is sufficiently high, however, the preheating process is not necessarily required. For example, therefore, the temperature of the outdoor air detected by the thermistor 19 is detected also by the outdoor air temperature detection circuit 44, and a temperature detection signal is applied from the detection circuit 44 to the microcomputer 25. The microcomputer 25 compares the temperature detection signal with a predetermined reference temperature signal, and if the temperature detection signal is higher than the reference temperature signal, that is, if the outdoor air temperature $\theta_H$ is higher than the reference temperature $\theta_O$, any nonrotating magnetic field signal is not applied to the transistor drive circuit 27. When the outdoor air temperature $\theta_H$ is lower than the reference temperature $\theta_O$, by contrast, the preheating time of T shown in FIG. 6*a* is allowed as predetermined.

Figure 6B:
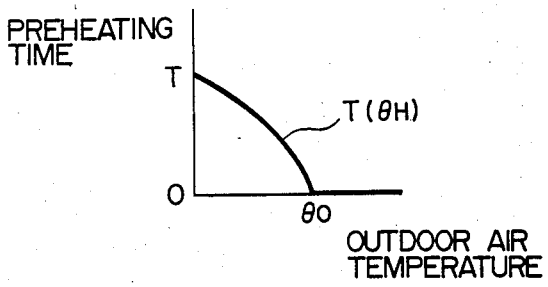

As shown in FIG. 6*b*, the preheating time T ($\theta_H$) may be given by a function of the outdoor air temperature $\theta_H$. In this case, the preheating time T ($\theta_H$) is given in accordance with the outdoor temperature $\theta_H$ obtained at the outdoor air temperature detection circuit 44. In other words, the preheating time T ($\theta_H$) shown in FIG. 6*b* is stored in the memory 25*c* in advance. The processing circuit 25*b* thus determines the preheating time T ($\theta_H$) by use of the outdoor air temperature $\theta_H$ detected by the outdoor air temperature detection circuit 44. The preheating time T ($\theta_H$) is subtracted from the operation start time stored in the memory by the operation switch 26 to determine the preheating start time $T_H$. The processing circuit 25*b* further compares the preheating start time with the present, time Tp indicated on the timer 25*a*. Until the preheating start time $T_H$ reaches the present time Tp, the processing circuit 25*b* repeats the computation. When the preheating start time $T_H$ reaches the present time Tp, the microcomputer 25 applies a non-rotating magnetic generation signal to the transistor drive circuit 27 to heat the compressor motor 12.

Figure 7:
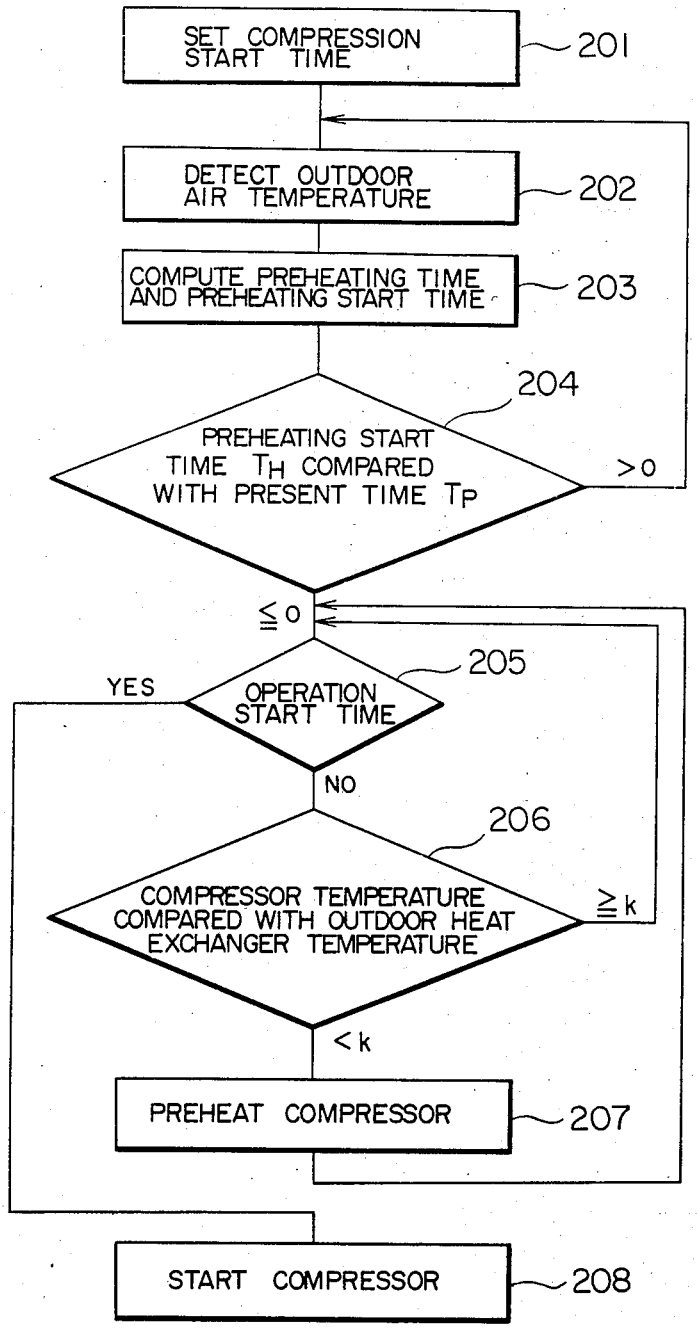
FIG. 7 is a flowchart showing an example of control procedures for a control system according to the present invention.

With the increase in the temperature of the compressor 15 by sufficient preheating thereof, the preheating of the compressor 15 is ceased. Specifically, the temperature of the case 16 of the compressor 15 is detected by the thermistor 17, and an output signal of the thermistor 17 is applied through the terminal 43 to the compressor temperature detection circuit 46. An output signal of the compressor temperature detection circuit 46 is in turn applied to the microcomputer 25. When the temperature of the compressor 15 reaches a predetermined reference temperature, the microcomputer 25 stops supplying the non-rotating magnetic field generation signal. This reference temperature is stored in advance in the memory 25*c*. Alternatively, the microcomputer 25 compares the temperature of the compressor 15 with that of the outdoor air 4*b* or the outdoor heat exchanger 4. Comparison between the temperature of the compressor 15 and that of the outdoor heat exchanger, however, is more preferable. This is for the reason that when the compressor 15 is heated, the refrigerant gas shifts from the compressor 15 to the outdoor heat exchanger 4 to increase the temperature of the outdoor heat exchanger 4, so that a sufficient heating of the compressor 15 causes a sufficient temperature difference between the compressor 15 and the outdoor heat exchanger 4. This control process is shown in the flowchart of FIG. 7. First, at a first step 201, the compressor start time $T_S$, that is, the operation start time of the air conditioner is set in the memory 25*c* of the microcomputer 25 by the operation switch 26. At a second step 202, the outdoor air temperature $\theta_H$ is detected by the outdoor air temperature detection circuit 44. At a third step 203, the preheating time T ($\theta_H$) and the preheating start time $T_H$ are determined at the processing circuit 25*b*. A fourth step 204 compares the preheating start time $T_H$ with the present time $T_P$. If the preheating start time $T_H$ has not yet reached the present time $T_P$, the process is returned to step 202. If the preheating start time $T_H$ has reached the present time $T_P$, by contrast, the process is passed to step 205 to decide whether the present time $T_P$ has reached the compressor start time $T_S$. If the present time $T_P$ is found to have reached the start time $T_S$, the process proceeds to an eighth step 208 to start compressor operation. Unless the present time $T_P$ reaches the time $T_S$, a sixth step 206 is performed, so that the temperature of the compressor 15 detected by the thermistor 18 is compared with the temperature of the outdoor heat exchanger 4. In the case where the temperature of the compressor 15 is higher than that of the outdoor heat exchanger 4 by a predetermined value k or more, the process is returned to step 205. If the temperature difference between the compressor 15 and the outdoor heat exchanger has not yet reached the value k, the step 207 is executed to preheat the compressor 15, followed by the process returning to step 205. When the present time $T_P$ reaches the operation start time $T_S$ of the air conditioner at step 205, the operation of the compressor 15 is started at the eighth step 208.

If the temperature of the compressor 15 remains low after the air conditioner is started, the current shown in FIG. 5 is supplied to the compressor motor 12 thereby to heat the compressor 15. Specifically, the temperature of the compressor 15 is detected by the thermistor 17 and the compressor temperature detection circuit 46, and if the temperature of the compressor 15 is found to be lower than a predetermined value T, a non-rotating magnetic field generation signal is superimposed on a rotating magnetic field generation signal thereby to supply the resulting combined signal to the transistor drive circuit 27, so that the compressor motor 12 is heated in rotation. This heat is carried to the outdoor heat exchanger by the refrigerant gas, thus heating the indoor air.

In defrosting the outdoor heat exchanger 4, too, the compressor motor 12 is supplied with a current for generating a rotating magnetic field and a current for generating a non-rotating magnetic field. For example, in the case where the temperature of the outdoor heat exchanger 4 detected by the thermistor 18 is lower than a predetermined temperature $T_F$ and the air-conditioner continues to be run for a predetermined period of time Hm, a current is supplied to the solenoid 2*a* of the reversal valve 2, so that the reversal valve 2 is switched to the dashed lines 9*c*, 9*d*, thus stopping the fans 3*a* and 4*a*. Thus, the auxiliary current 90 superimposed on current as shown in FIG. 5 is applied to the compressor motor 12, with the result that the compressor motor 12 is heated thereby to carry heat energy to the outdoor heat exchanger 4 by the refrigerant gas. As a consequence, the outdoor heat exchanger 4 is heated and the frost attached to the surface thereof is removed. Upon detection of a temperature increase of the outdoor heat exchanger 4 by the thermistor 18, the reversal valve 2 is switched again to the solid lines 9*a*, 9*b* thereby to restart the heating operation of the air conditioner.

It will be understood from the foregoing description that according to the present invention, the current for generating a non-rotating magnetic field is supplied to a compressor motor to preheat a compressor from within, thus easily increasing the temperature of the compressor. As a result, the indoor air is heated within a short time following the start of an air conditioner. According to another aspect of the invention, currents for generating a rotating magnetic field and a non-rotating magnetic field flow at the same time in the compressor motor, and therefore the compressor motor is heated while being driven. This heat energy heats the indoor air, thereby easily heating the indoor air even when the outdoor air is low in temperature. Further, the outdoor heat exchanger is easily defrosted by the heat energy generated in the compressor. According to still another aspect of the invention, the compressor is preheated to heat the refrigeration oil in the compressor. Thus gasifying the refrigerant gas molten in the refrigeration oil. As a result, the viscosity of the refrigeration oil is maintained at a right value for right lubrication of compressor bearings.

We claim:

1. A control system for a compressor motor of an air condition unit comprising a refrigerant compressor having the compressor motor, an outdoor coil, a restrictor, and an indoor coil, said control system comprising:

(a) an operation switch, (b) a microcomputer connected to said operation switch and including timer, a processing circuit and a memory for storing data on a rotating magnetic field generation signal capable of supplying a first current for generating a rotating magnetic field to the compressor motor and data on a non-rotating magnetic field generation signal capable of supplying a second current for generating a non-rotating magnetic field, said memory being supplied from the operation switch with data designating the operation start time of the heat pump, which data is stored in said memory, said microcomputer introducing data for generating a non-rotating magnetic field from said memory before the heat pump start time thereby to generate a non-rotating magnetic field generation signal, said microcomputer further introducing data for generating a rotating magnetic field from the memory after said start time to generate a rotating magnetic field generation signal, (c) compressor motor drive means inserted between said microcomputer and said compressor motor and supplied with a non-rotating magnetic field generation signal and a rotating magnetic field generation signal from the microcomputer, said signals being applied to said compressor motor, (d) outdoor air temperature detection means for detecting the outdoor air temperature $\theta_H$, (e) means for providing a start time T ($\theta_H$) to start introduction of the data for generating a non-rotating magnetic field from said memory in accordance with the outdoor air temperature $\theta_H$, and (f) means for starting generation of a signal for generating a non-rotating magnetic field at the start time T ($\theta_H$).

2. A control system for a compressor motor of an air conditioning unit comprising a refrigerant compressor having the compressor motor, an outdoor coil, a restrictor, and an indoor coil, said control system comprising:

(a) an operation switch, (b) a microcomputer connected to said operation switch and including a timer, a processing circuit and a memory for storing data on a rotating magnetic field generation signal capable of supplying a first current for generating a rotating magnetic field to the compressor motor and data on a non-rotating magnetic field generation signal capable of supplying a second current for gnerating a non-rotating magnetic field, said memory being supplied from the operation switch with data designating the operation start time of the heat pump, which data is stored in said memory, said microcomputer introducing data for generating a non-rotating magnetic field from said memory before the heat pump start time thereby to generate a non-rotating magnetic field generation signal, said microcomputer further introducing data for generating a rotating magnetic field from the memory after said start time to generate a rotating magnetic field generation signal, (c) compressor motor drive means inserted between said microcomputer and said compressor motor and supplied with a non-rotating magnetic field generation signal and a rotating magnetic field generation signal from the microcomputer, said signals being applied to said compressor motor, (d) means for detecting the temperature of the compressor, and (e) means for stopping generation of the signal for generating a non-rotating magnetic field when the compressor temperature exceeds aa predetermined temperature.

3. A control system according to claim 1, further comprising means for detecting the temperature of the compressor and means for stopping generation of the signal for generating a non-rotating magnetic field when the compressor temperature exceeds a predetermined temperature.

4. A control system for a compressor motor of an air conditioning unit comprising a refrigerant compressor having the compressor motor, an outdoor coil, a restrictor, and an indoor coil, said control system comprising:

(a) an operation switch, (b) a microcomputer connected to said operation switch and including a timer, a processible circuit and a memory for storing data on a rotating magnetic field generation signal capable of supplying a first current for generating a rotating magnetic field to the compressor motor and data on a non-rotating magnetic field generation signal capable of supplying a second current for generating a non-rotating magnetic field, said memory being supplied from the operation switch with data designating the operation start time of the heat pump, which data is stored in said memory, said microcomputer introducing data for generating a non-rotating magnetic field from said memory before the heat pump start time thereby to generate a non-rotating magnetic field generation signal, said microcomputer further introducing data for generating a rotating magnetic field from the memory after said start time to generate a rotating magnetic field generation signal, (c) compressor motor drive means inserted between said microcomputer and said compressor motor and supplied with a non-rotating magnetic field generation signal and a rotating magnetic field generation signal from the microcomputer, said signals being applied to said compressor motor, (d) means for detecting the temperature of the compressor, and (e) means for detecting the temperature of the outdoor coil, wherein the signal for generating a non-rotating magnetic field stops being generated when the compressor temperature reaches a level higher than the temperature of the outdoor coil by a predetermined value.

5. A control system according to claim 1, further comprising means for detecting the temperature of the compressor and means for detecting the temperature of the outdoor coil, wherein the signal for generating a non-rotating magnetic field stops being generated when the compressor temperature reaches a level higher than the temperature of the outdoor coil by a predetermined value.

6. A control system for a compressor motor of an air conditioning unit comprising a refrigerant compressor having the compressor motor, an outdoor coil, a restrictor, an indoor coil and a reversal valve, said control system comprising:

(a) an operation switch, (b) a microcomputer connected to said operation switch and including a timer, a processing circuit and a memory for storing data on a rotating magnetic field generation signal capable of supplying a first current for generating a rotating magnetic field to the compressor motor and data on a non-rotating magnetic field generation signal capable of supplying a second current for generating a non-rotating magnetic field, said memory being supplying from the operation switch with data designating the operation start time of the heat pump, said microcomputer introducing data for generating a non-rotating magnetic field and data for generating a rotating magnetic field from said memory, said microcomputer further generating a combined signal containing the non-rotating magnetic field generation signal superimposed on the rotating magnetic field generation signal after said operation start time of the heat pump, and (c) compressor motor drive means inserted between said microcomputer and said compressor motor, said combined signal being supplied from said microcomputer to said compressor motor.

7. A control system according to claim 6, further comprising means for detecting the temperature of the compressor, said combined signal being generated when the compressor temperature is lower than a predetermined temperature.

8. A control system according to claim 6, wherein said combined signal is generated in a manner to defrost the surface of the outdoor coil.

* * * * *